US007001240B1

(12) United States Patent
Huffman-Jimenez

(10) Patent No.: US 7,001,240 B1
(45) Date of Patent: Feb. 21, 2006

(54) BRASSIERES

(76) Inventor: Teri A. Huffman-Jimenez, 2517 276th St. #7, Mont Rose, IA (US) 52639

( * ) Notice: Subject to any disclaimer, the term of this patent is extended or adjusted under 35 U.S.C. 154(b) by 0 days.

(21) Appl. No.: 10/684,319

(22) Filed: Oct. 11, 2003

Related U.S. Application Data

(60) Provisional application No. 60/417,994, filed on Oct. 12, 2002.

(51) Int. Cl.
*A41C 3/00* (2006.01)

(52) U.S. Cl. ..... 450/58; 450/60

(58) Field of Classification Search ..... 450/58, 450/1, 7, 22, 30, 31, 32, 86, 88, 60–73; 2/78.1–78.3, 2/107, 117, 73, 104–106, 243.1, 85, 96, 336, 2/338, 311, 312, 321, 322
See application file for complete search history.

(56) References Cited

U.S. PATENT DOCUMENTS 3,040,750 A * 6/1962 Hurwitz ..... 450/58
3,311,112 A * 3/1967 Murray ..... 450/1
3,826,266 A * 7/1974 Alpert ..... 450/11
4,269,191 A 5/1981 Evans
4,411,269 A * 10/1983 Weintraub ..... 450/58
4,416,284 A 11/1983 Fink, IV
5,702,285 A 12/1997 Orlando
5,966,740 A * 10/1999 Barbe-Vicuna ..... 2/73
6,131,206 A * 10/2000 Vayda ..... 2/315
6,200,194 B1 3/2001 Grier
6,517,409 B1 * 2/2003 Flaherty ..... 450/1

* cited by examiner

*Primary Examiner*—Gloria M. Hale
(74) *Attorney, Agent, or Firm*—Thomas E. Frantz

(57) ABSTRACT

A brassiere for use by women having asymmetrical breasts which are not comfortably or properly received in and/or supported by the symmetrical breast cups as provided in the usual brassiere. The brassiere comprises a garment having a unitary body section which encircles the midriff of a woman with asymmetrical breasts, a closure for adjusting the body section of the brassiere to fit the midriff of the woman, and a pair of asymmetrical breast cups carried by the body section, the body section positioning the cups to comfortably and properly receive and support the woman's asymmetrical breasts. The brassiere may be turned inside-out to reverse orientation of the cups.

7 Claims, 7 Drawing Sheets

Fig. 3A
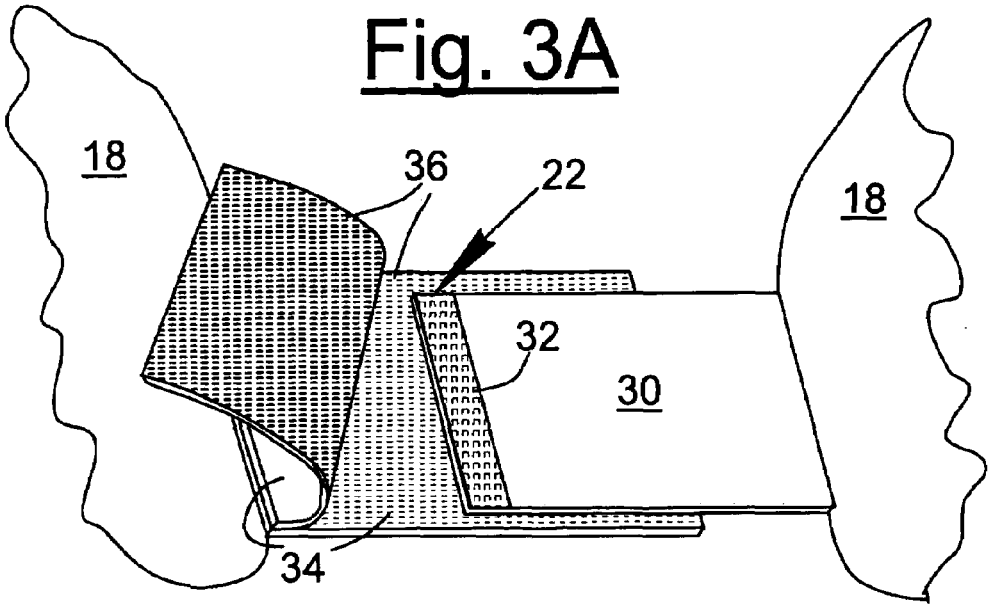
Fig. 3B
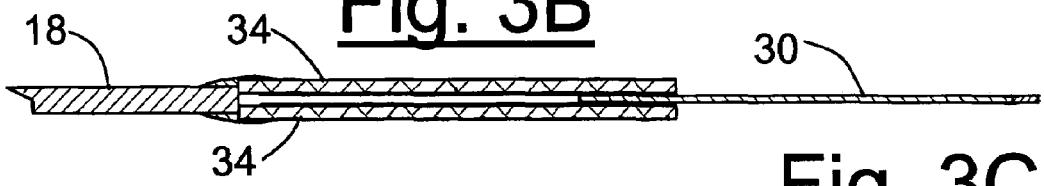
Fig. 3C
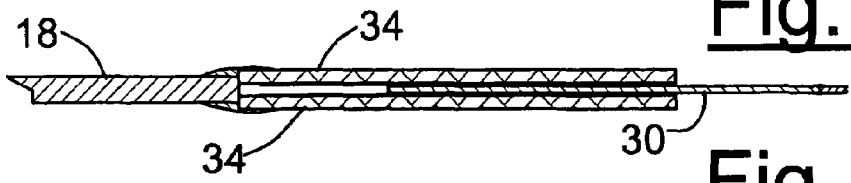
Fig. 3D
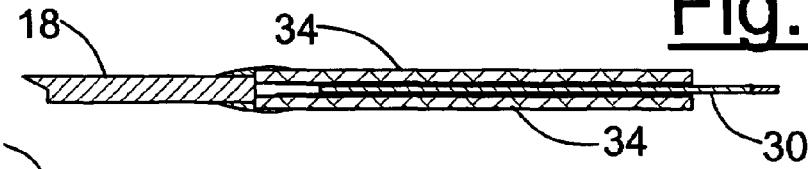
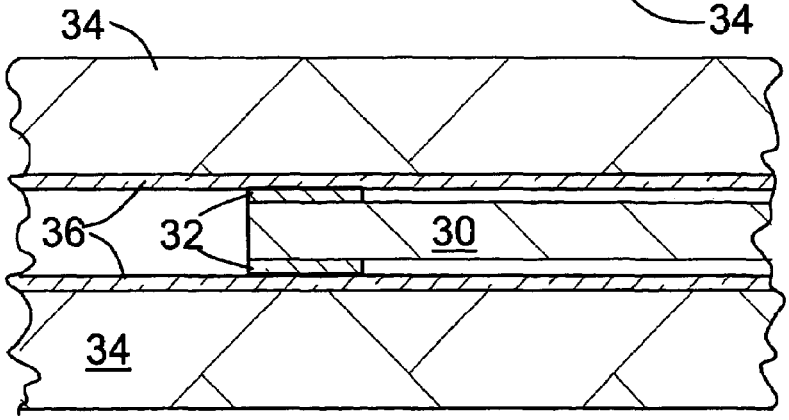
Fig. 3E 84
86
88
90
92
94
96
98
100
102
104
108
110
112

116
122
128
126
124
118

116
122
120
122
118

116
122
126
128
124
122
118

116
134
138
122
128
126
124
134
138
118

116
134
136
138
122
138
120
134
136
122
118

116
134
138
126
128
134
138
122
124
118

BRASSIERES

This application claims the benefit of U.S. Provisional Patent Application No. 60/417,994 filed Oct. 12, 2002.

FIELD OF INVENTION

The present invention relates generally to women's upper body garments.

More particularly, this invention relates to garments of the type worn by women to support their breasts, and it is specially intended for use in providing brassieres with asymmetrically sized breast receiving cups for use by women having asymmetrical sized breasts.

DESCRIPTION OF PRIOR ART

As individuals develop and grow between childhood and adulthood, it is not unusual to find in a significant percentage of people that all parts of the two sides of their bodies have not grown or developed at precisely the same rate. This is why a certain percentage of people will experience difficulty in finding a pair of shoes which comfortably fit both feet—one foot having out-grown the other. In some instances, in fact, the disparity in foot size has been known to require the purchase of two sets of shoes of the same design but of different sizes, with one shoe from each set then being worn and the other two discarded.

Another problem area resulting from this disparity in growth is with differences in breast size as experienced by a fairly substantial number of women. Much like the problem of finding a shoe size which is comfortable on asymmetrical feet, women with asymmetrical breasts seldom are successful in finding commercially available brassieres which comfortably fit and support both breasts. Brassieres are sold with one cup size only. They vary in midriff size and cup size, but are not available with different size cups in the same brassiere.

Unlike shoes, brassieres are not commonly sold in sets of two individual cup sections which would permit a woman to buy two different sized sets of two cup sections each, and then select, assemble and wear one section of each cup size. Thus, women with asymmetrical breasts, even if they might be willing to accept the double cost of and problems involved in trying to fit together two sets of brassiere sections, are not able to buy brassieres which properly fit and support their breasts. This is a particularly vexing problem in those cases where a women needs a brassiere with under wire support.

In the past, various proposals have been made for brassieres or like body garments intended for use by women who have had a breast removed or otherwise reduced through surgery. As shown in representative patents, U.S. Pat. Nos. 4,269,191; 5,702,285 and 5,966,740 the prior art has suggested such arrangements as a brassiere having (a) one cup and one flat panel, (b) entirely separate cup sections, and (c) a multi-piece assembly.

None of these prior suggestions have been directed toward nor have they in any way provided commercially available unitary brassieres capable of solving the long standing problem experienced by many women in trying to find a comfortably fitting product for use with naturally occurring asymmetrical breasts.

SUMMARY OF INVENTION

The general aim of the present invention is to provide a new and improved unitary breast support structure in a brassiere.

DETAILED OBJECTIVES OF THE INVENTION

To provide a novel brassiere particularly intended for use by women with asymmetrical breasts, such brassiere having breast cups individually sized to comfortably receive and support the breast to be positioned therein.

The provision of an unique brassiere comprising a unitary garment having asymmetrical breast cups and a body section for supporting such cups in position on the chest of the user, the circumference of such body section being adjustable to provide a comfortable fit over the chest of the wearer.

To provide a new and novel brassiere for use by a woman having asymmetrical breasts, such brassiere comprising a unitary garment having a body section adapted to encircle the chest of the woman, closure means provided by the body section and adapted to permit opening the body member for donning or removing the brassiere and for adjusting the circumference of the body member to fit the girth of the wearer, and a pair of asymmetrical breast cups carried by the body section, such body section positioning the asymmetrical cups to comfortably receive and support the asymmetrical breasts of the woman.

The invention also resides in the provision of a brassiere having asymmetrical breast receiving cups, the brassiere being reversible by being turned inside out to reverse the orientation of the breast cups relative to the anatomy of a woman whereby the same brassiere is usable regardless of the positioning of the breasts.

These and other objectives and advantages of the invention will become more apparent from the following detailed description when taken in conjunction with the accompanying drawings.

BRIEF DESCRIPTION OF THE DRAWINGS

FIG. 3A is an enlarged front perspective view of the closure of FIG. 1, showing the details of the new and unique Velcro closure used in the embodiment of FIG. 1.

FIGS. 3B, 3C and 3D are partial top plan views showing positioning of parts of the Velcro closure of FIG. 3A as disposed to accommodate various sized chests or midriffs.

FIG. 3E is an enlarged partial top plan view of the Velcro closure of FIG. 3A showing both panels closed.

DETAILED DESCRIPTION

Figure 1:
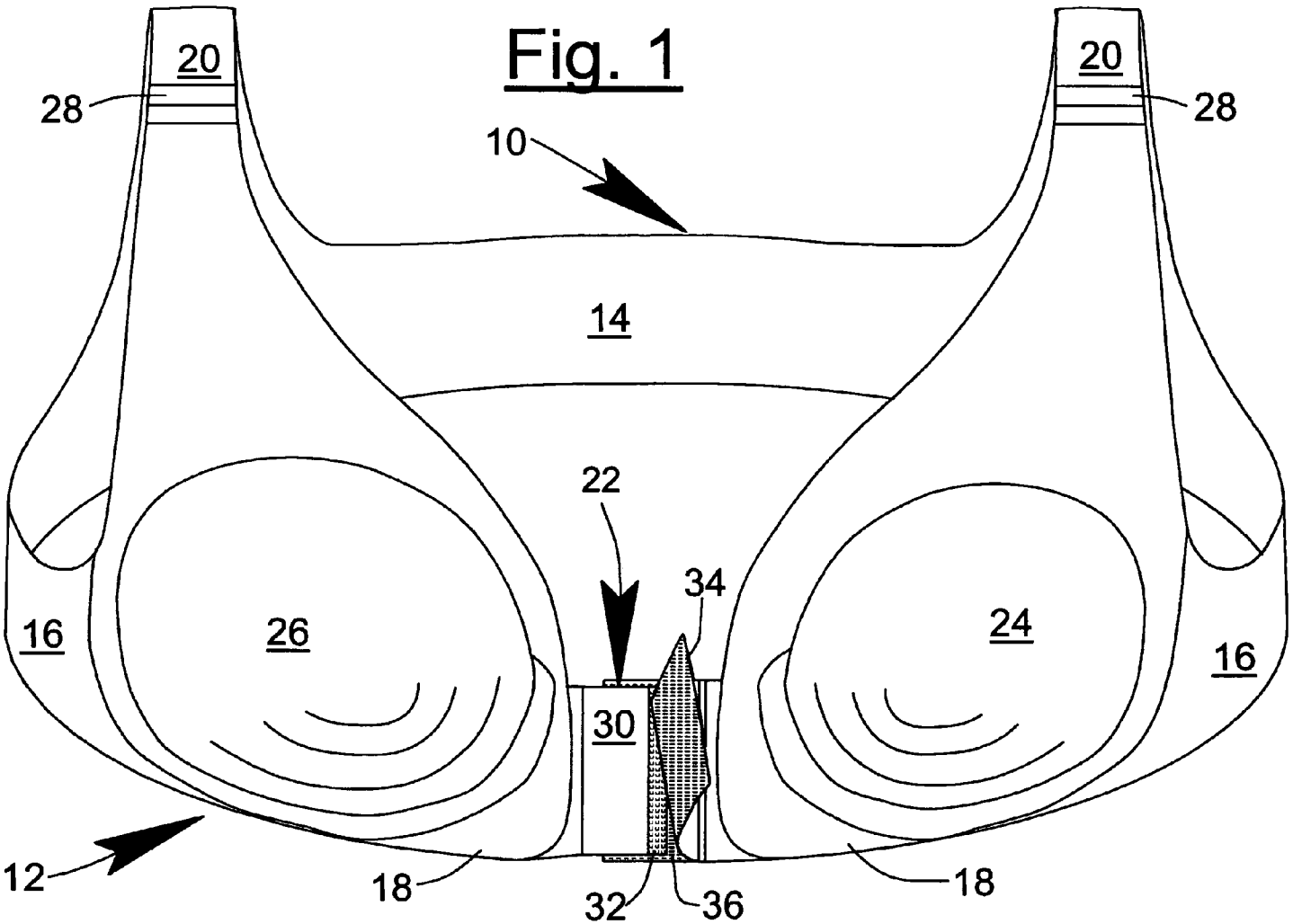
FIG. 1 is a front perspective view of a new and improved brassiere incorporating asymmetrical cups and other unique aspects of the present invention.

Throughout this application, certain words are used for convenience only and are not to be construed as limiting. The word "brassiere" is used in its broadest sense to refer to any upper body garment that is intended to be worn by a woman to support her breasts, whether that garment normally is worn as outer clothing (e.g. a swimming suit top) or under other clothing. Also, throughout this application, common and usual details of sewing, construction and style (e.g. stitching, hems, mesh areas, lace and like fanciful edging etc.) normally involved in manufacturing brassieres are not shown or described, as this invention is not directed to such details except to the extent that they might adversely affect the comfort of a brassiere. Additionally, in the drawings, like elements in the same or different embodiments or views have been identified with like reference numerals throughout. Also, where a particular element may be shown several times in the same drawing view, it may not be numbered each time it is shown in that view, and all elements shown in one view of an embodiment may not be shown in all other views of that same embodiment.

First Embodiment Shown in FIGS. 1 Through 3E.

As illustrated in FIGS. 1–3E, the brassiere 10 of this embodiment generally comprises

- a body portion 12, including a back section 14, side sections 16, and front sections 18, such body portion having therein a discontinuity releasably and selectively closed with a closure device,
- shoulder straps 20,
- closure 22, and
- asymmetrical breast cups including right cup 24 and left cup 26.

Figure 2A:
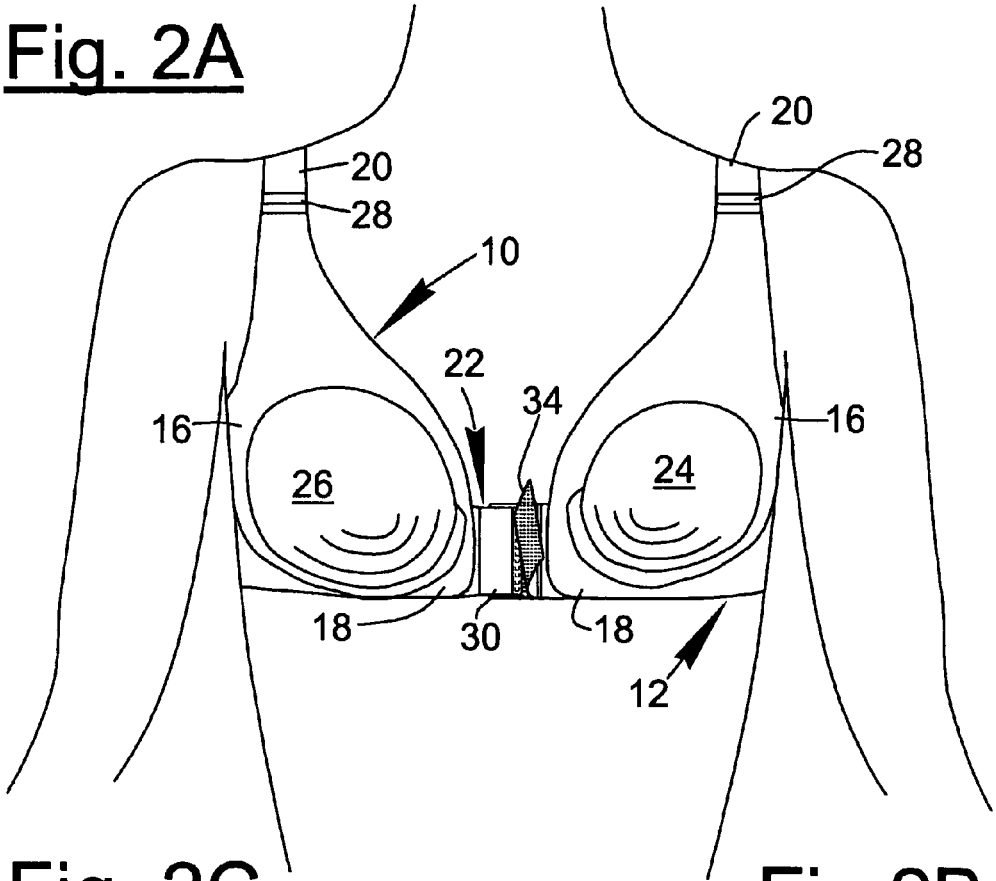
FIG. 2A is a front view of the brassiere of FIG. 1 as disposed on the figure of a woman with one panel of the front closure being open.
Figure 2C:
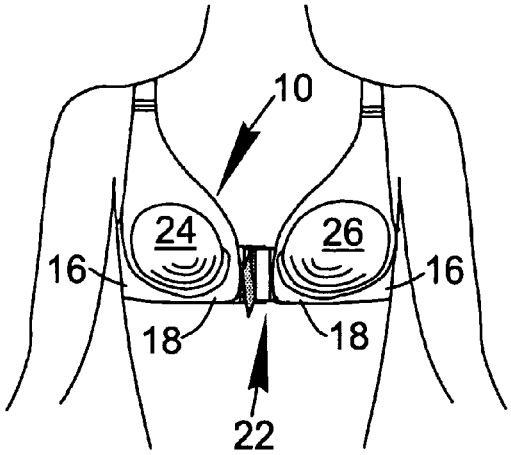
FIG. 2C is a reduced front view of the brassiere of FIG. 1, with the brassiere being turned inside out to reverse the position of the cups and the closure, with the other panel of the closure being open.
Figure 2B:
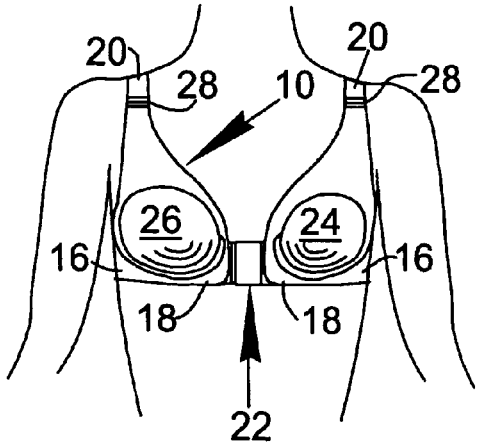
FIG. 2B is a reduced front view of the brassiere of FIG. 1, with the closure closed.

As will be noted from FIGS. 1–2B, the left breast cup 26 is larger than right breast cup 24, an arrangement intended to fit a woman with asymmetrical breasts in which the right breast is larger than the left breast. In FIG. 2C, however, it will be seen that the position of the cups has been reversed relative to the body of a wearer, with the smaller cup 24 being positioned to the left. Such reversal may be accomplished, of course, during manufacture of the brassiere. In this embodiment, however, such reversal is accomplished very simply—by turning the brassiere inside-out (hereinafter generally characterized as "reversible" or "reversed"). Thus, to accommodate women with the same chest size but oppositely positioned asymmetrical breasts, the manufacturer would have to manufacture and the retailer would have to carry only one brassiere of a given style or price range for each combination of cup sizes. For instance, a reversible brassiere with a chest size of 28" and one C and one D cup would properly and comfortably fit any women with a midriff of about 28" and asymmetrical C and D size breasts regardless of the positioning of the breasts.

Shoulder straps 20 are provided with strap adjusting means 28, preferably positioned forwardly of the shoulders where they are easily accessed for length adjustment after the brassiere has been donned. The adjusting means 28 may be comprised of any one of several types now used widely and well known in the art.

As will be obvious to those in the art, manufacture of a reversible brassiere of the nature described above requires that care be taken to select materials, sewing methods, cup construction, and seam size and positioning to assure that the brassiere not only reverses readily but that it provides a smooth and comfortable feel regardless of the side contacting the wearer's skin.

Front closure 22 provides a new and novel arrangement which not only is particularly useful in connection with reversible brassieres in accordance with this invention but provides a definite improvement in the degree of adjustment available in selecting the most comfortable point of closure of body portion 12 around the chest.

As best seen in FIGS. 3A–3E, closure 22 comprises a center panel 30 formed of a smooth flexible fabric or like material which is attached at one end to one of the brassiere's front sections 18 and provided on each side at its distal free end with a relatively narrow band of Velcro hook material 32. Attached to the other front section 18 is a receptor unit comprising two coextensive flexible receptor panels 34, each of which has a smooth exterior surface and an interior surface lined with Velcro Loop material 36. In adjusting closure 22 after donning brassiere 10, the user merely

- separates the receptor panels 34 by bending the outer panel back as shown in FIGS. 1, 2A, and 3A,
- pulls the center panel 30 and receptor panels 34 toward each other until reaching a position which is comfortable on her chest,
- presses the center panel 30 back to engage the hook material 32 on the back side thereof with the loop material 36 on the inner receptor panel 34, and
- then folds the outer receptor panel 34 inwardly to engage the loop material 36 thereon with the hook material 32 on the outer side of center panel 30.

Removal of the brassiere merely involves reversal of the above steps.

Referring now to FIGS. 3B–3D, it will be seen that the user of the brassiere 10 has a considerable range for placement of the center panel 30 relative to receptor panels 34 in adjusting the body portion 12 to provide a comfortable fit around her upper body. It also will be seen that, whether or not reversed, at no time is the hook material 32 or loop material 36 ever exposed either to view or for contact with the skin of the wearer.

Figure 4A:
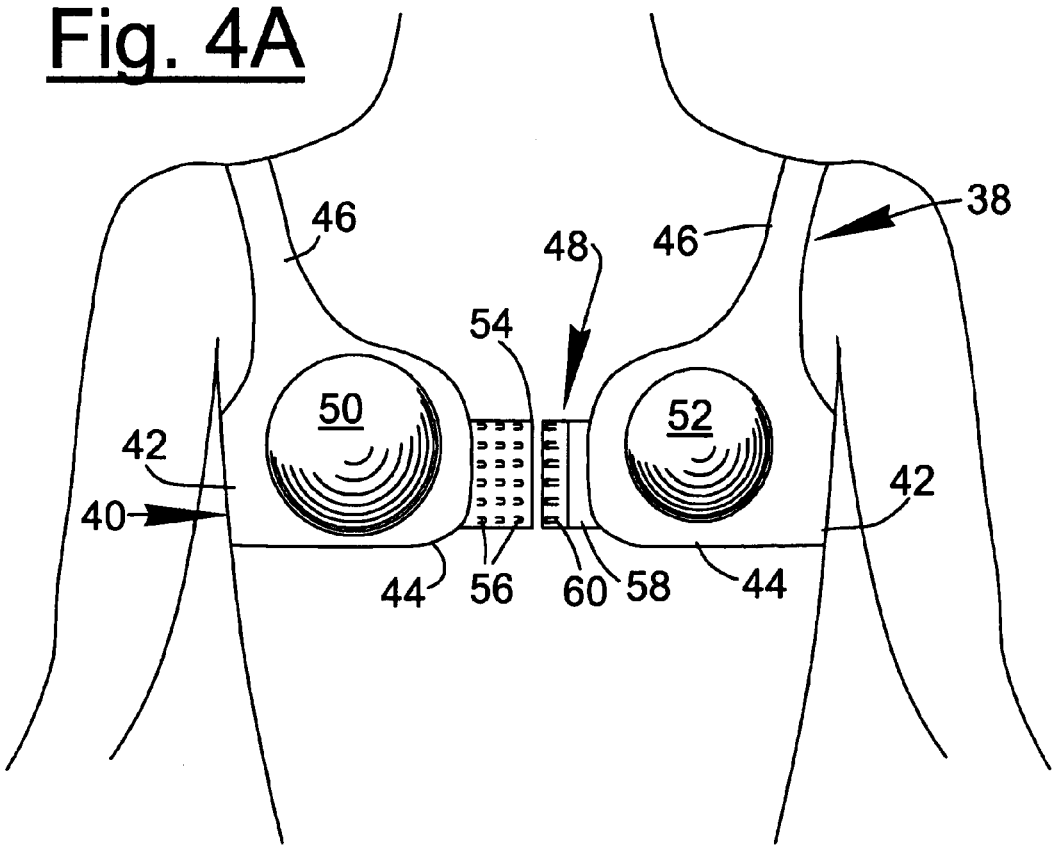
FIG. 4A is a front view of another embodiment of this invention, showing use of a front closure comprising a series of loops and hooks.
Figure 4C:
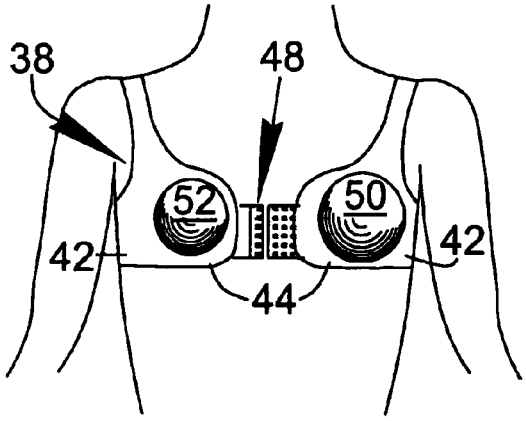
FIG. 4C is a reduced front view of the brassiere of FIG. 4A with the position of the cups and closure being reversed and with the closure open.
Figure 4B:
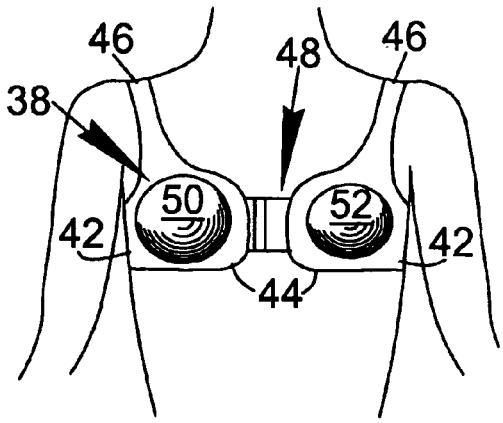
FIG. 4B is a reduced front view of the embodiment of FIG. 4A showing the hooks and loops engaged and the closure closed.

Alternate Embodiment Shown in FIGS. 4A–4C

The alternate embodiment 38 shown in FIGS. 4A–4C is similar to the embodiment described above, including

- a body portion 40 comprising a back section (not shown), side sections 42 and front sections 44,
- shoulder straps 46 extending upwardly from front sections 44,
- closure means 48, and
- asymmetrical breast cups 48 and 50 provided in front sections 44.

As shown in FIG. 4A, the left breast cup 50 is larger than the right cup 48, thus providing a brassiere suitable for use by a woman having asymmetrical breasts, of which the right breast is the larger. Depending upon the extent of this size difference, a brassiere providing a difference of one cup size may be adequate, but in some cases more or less than one cup size difference may be desirable. Thus, to accommodate all possible needs, it may be desirable to provide a line of asymmetrical brassieres offering cup size differences of one half, one, and one and one half.

The closure 48 of this embodiment is of a well known type, consisting of

- a generally rectangular panel 54 attached to one of the front sections 44 and provided with three parallel vertically disposed columns of relatively small wire loops 56 and
- a second panel 58 attached to the other front section 44 and provided with one vertically disposed column of wire hooks 60.

As will be obvious, after the brassiere has been donned, the panels 54 and 58 are to be drawn together to the point where the body portion 40 fits comfortably, and the hooks 60 then engaged with the closest column of loops 56.

It might be observed at this point that, while the hook/loop closure of this embodiment is generally adequate for many wearers, it would not be as responsive to the need for a comfortable fit as closure 22 of the earlier embodiment since closure 22 can be engaged at any point along receptor panels 34 and is not limited to three predetermined positions.

FIG. 4B shows the closure 48 in a closed position, and FIG. 4C shows the brassiere 38 with the closure 48 open and as having the cups 50 and 52 reversed to accommodate a woman with a smaller breast on her left side.

Should it be desired to make brassiere 38 reversible, it would be preferable to add to the closure 48 an extra panel which would cover any exposed loops 56 when positioned toward the body of the wearer.

Figure 5A:
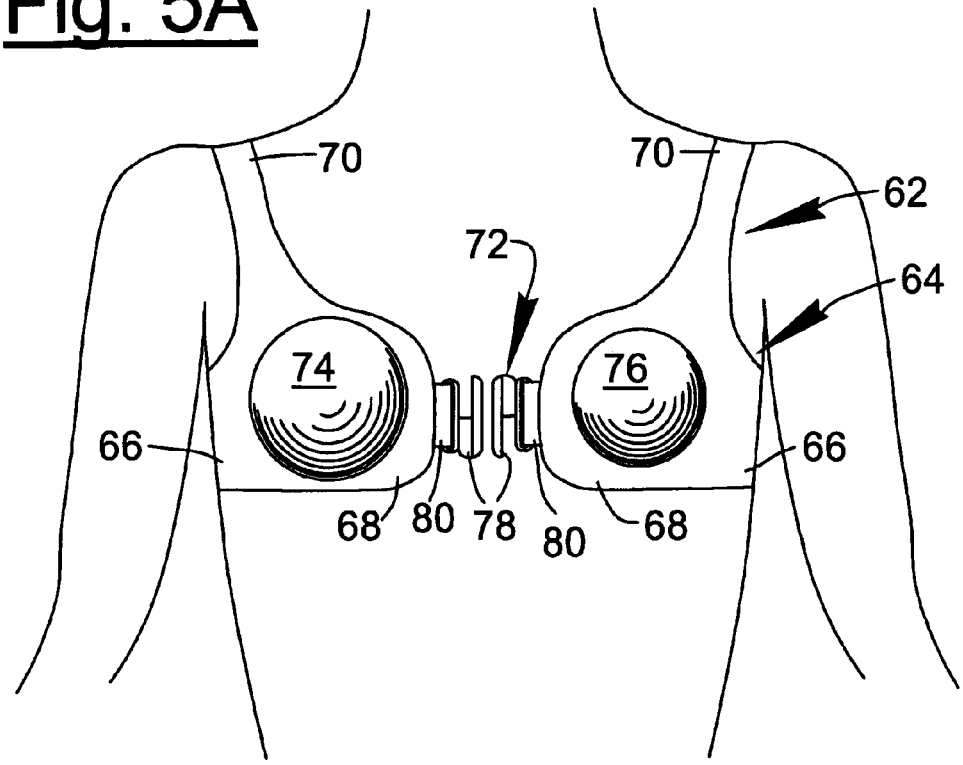
FIG. 5A is a front view of another embodiment of this invention, showing use of a front closing closure comprising elastic fabric connectors supporting hook members which snap together.
Figure 5C:
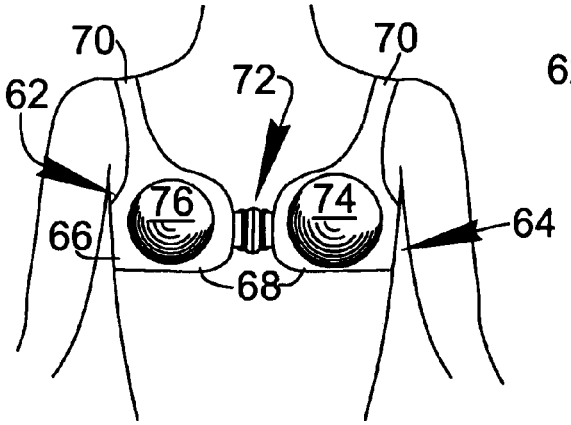
FIG. 5C is a reduced front view of the brassiere of FIG. 5A with the position of the cups being reversed and the hook members snapped together.
Figure 5B:
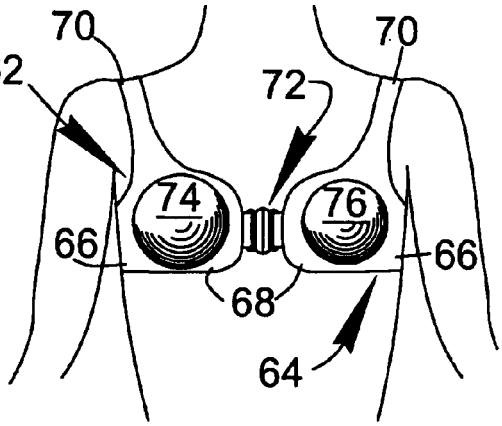
FIG. 5B is a reduced front view of the embodiment of FIG. 5A showing the hook members of the closure as being snapped together.

Alternate Embodiment Shown in FIGS. 5A–5C

The alternate embodiment 62 shown in FIGS. 5A–5C is similar to the embodiments described above, including

- a body portion 64 comprising a back section (not shown), side sections 66 and front sections 68,
- shoulder straps 70,
- closure 72, and
- asymmetrical breast cups 74 and 76.

The left breast cup 74 is shown in FIGS. 5A and 5B as being larger than the right cup 76, thus providing a brassiere adapted for reception and support of asymmetrical breasts, of which the left breast is the smaller. Depending upon the extent of this size difference, a brassiere providing a difference anywhere between one half and one and one half sizes may be appropriate.

The closure 72 of this embodiment is of a known type, consisting of a plastic latch member 78 connected to each front section 68 by a panel of elastic material 80. As will be noted, particularly from FIG. 5A, the latch members 78 are facing in opposite vertical directions. To operate closure 72 after donning the brassiere 62, latch members 78 are first hooked together vertically and then pressed rotatively to snap them together to secure body portion 64 around the chest of the wearer.

As with the earlier described embodiment of FIGS. 4A–4C, while the snap closure of this embodiment is generally adequate for many wearers, it would not be as responsive to the need for a comfortable fit as either closure 22 or closure 48 of the earlier embodiments since it is limited to one predetermined closure position. However, elastic panels 80 or similar panels installed elsewhere in the body portion 64 normally will provide enough "give" to compensate to a great extent for this limitation.

FIGS. 5B and 5C show the closure 72 in a closed position, with FIG. 5C also showing the cups 74 and 76 as being reversed to accommodate a woman with a smaller breast on her right side. Here again, if care is used in the selection of the fabrics, stitching, hems, etc. involved in the manufacture of cups and other components of this brassiere, it too would be readily reversible.

Alternate Embodiments Shown in FIGS. 6A–6C and 7A–7C

Figures 6A, 6B, 6C, 7A, 7B, 7C:
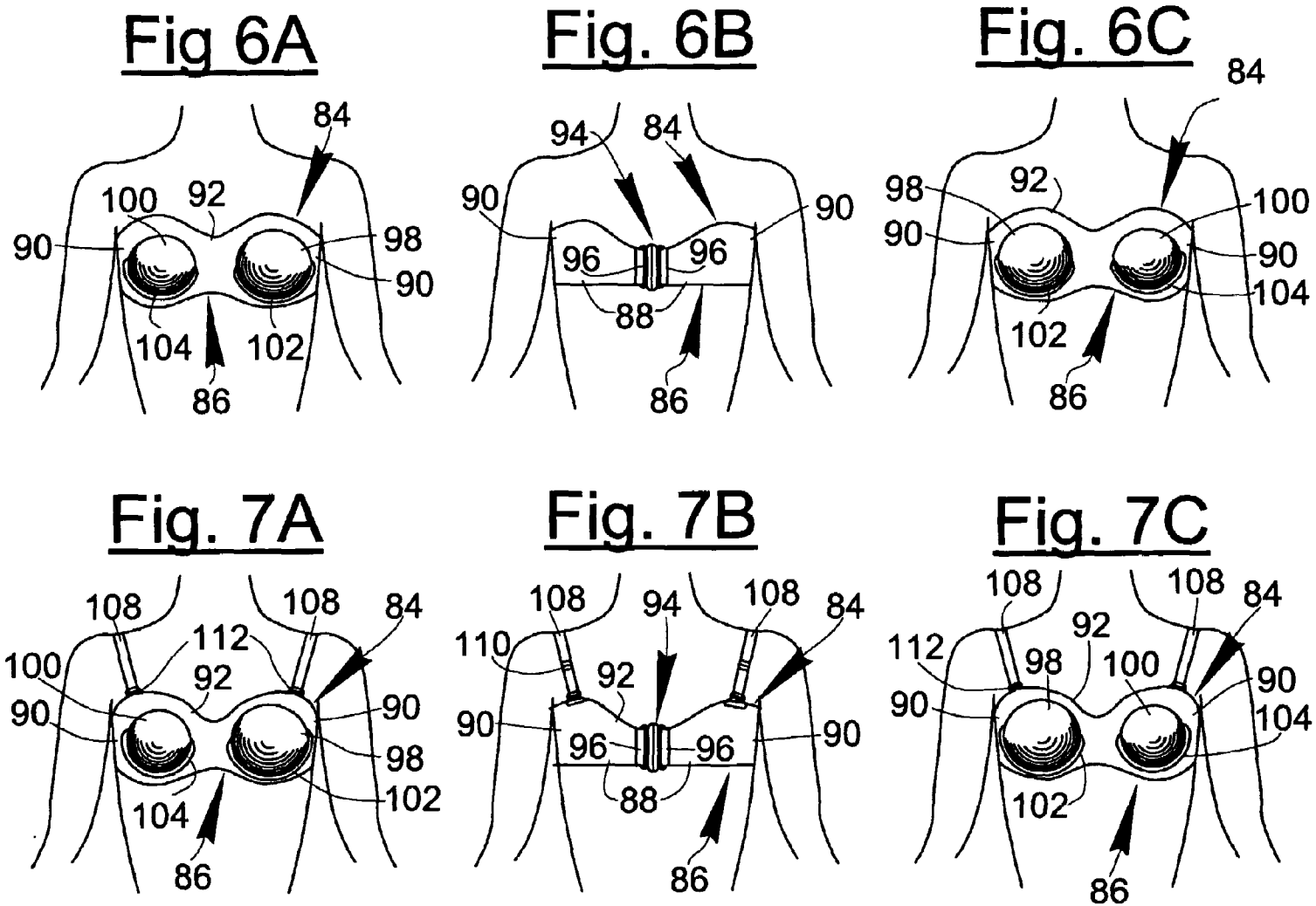
FIGS. 6A and 6B are front and back views of another embodiment of this invention, comprising a brassiere with a snap-together back closure, with under wires and without shoulder straps.
FIG. 6C is a front view of the FIG. 6A embodiment, showing the brassiere and the positioning of the breast cups as being reversed.
FIGS. 7A, 7B and 7C are front and back views of a brassiere according to the embodiment of FIGS. 6A, 6B and 6C wherein the brassiere includes use of selectively removable shoulder straps.

These embodiments are quite similar, except that the embodiment of FIGS. 6A–6C does not include the use of shoulder straps whereas the embodiment of FIGS. 7A–7C does provide for use of shoulder straps which are selectively removable from the brassiere.

More particularly, the embodiment of FIGS. 6A–6C shows a strapless brassiere 84 including

- a body portion 86 comprising back sections 88, side sections 90, and front section 92,
- back closure 94,
- elastic panels 96
- asymmetrical breast cups 98 and 100, and
- underwires 102 and 104.

The right breast cup 98 is shown in FIG. 6A as being larger than the left cup 100, thus providing a brassiere adapted for reception and support of breasts, of which the right breast is the smaller. As in earlier embodiments, depending upon the extent of this size difference, a brassiere 84 providing a cup difference anywhere between one half and one and one half sizes may be appropriate.

In the event that a fairly significant size difference (e.g. one or one and one half) between the asymmetrical cups of this or other embodiments described herein might be great enough to be noticed under a sweater or other somewhat snug garment, the smaller of the two cups 100 could readily be provided with a cup shaped outer cover produced from a relatively thick or padded material capable of providing a profile equaling that of the larger cup when positioned on the chest of the wearer.

The closure 94 of this embodiment is a snap closure of the same basic type as discussed in detail above in connection with the embodiment of FIGS. 5A–5C, consisting of plastic latch members 106 connected to each back section 88 by a panel of elastic material 96.

As with the earlier described embodiment of FIGS. 5A–5C, while body portion 86 with snap closure 94 of this embodiment is generally adequate for many wearers, elastic panels 96 connecting back sections 88 to back closure 94 normally will provide body portion 86 with sufficient "give" to fit comfortably around the wearer's chest FIG. 6C shows the cups 98 and 100 and underwires 102 and 104 as being reversed to accommodate a woman with a smaller breast on her left side. Here again, if care is used in the selection of the fabrics, stitching, hems, etc. involved in the manufacture of this brassiere 84, it too will be readily reversible and comfortable in either mode.

Also, if the brassiere is intended to be of the reversible type, the underwires 102 and 104 should provide sufficient resiliency to accommodate the slight curvature reversal that would be involved. Further, the wires should be encased in a pocket formed in the lower seam of the cup.

The FIGS. 7A–7C embodiment is the same as the FIGS. 6A–6C embodiment except for the addition of removable and adjustable shoulder straps 108. Each strap 108 preferably includes length adjusting means 110, which may be any one of several devices now known and used for adjusting the length of such straps. Each end of each strap is provided with a hook member 112 which is removably positioned in a short open ended channel 114 (see FIG. 7B) formed in the body portion 84 at the positions shown in the drawings.

Excluding the matter of the shoulder straps 108, all descriptions and comments concerning the embodiment of FIGS. 6A–6C apply to the embodiment of FIGS. 7A–7C.

Alternate Embodiments Shown in FIGS. 8A–8C and 9A–9C

Figures 8A, 8B, 8C, 9A, 9B, 9C:
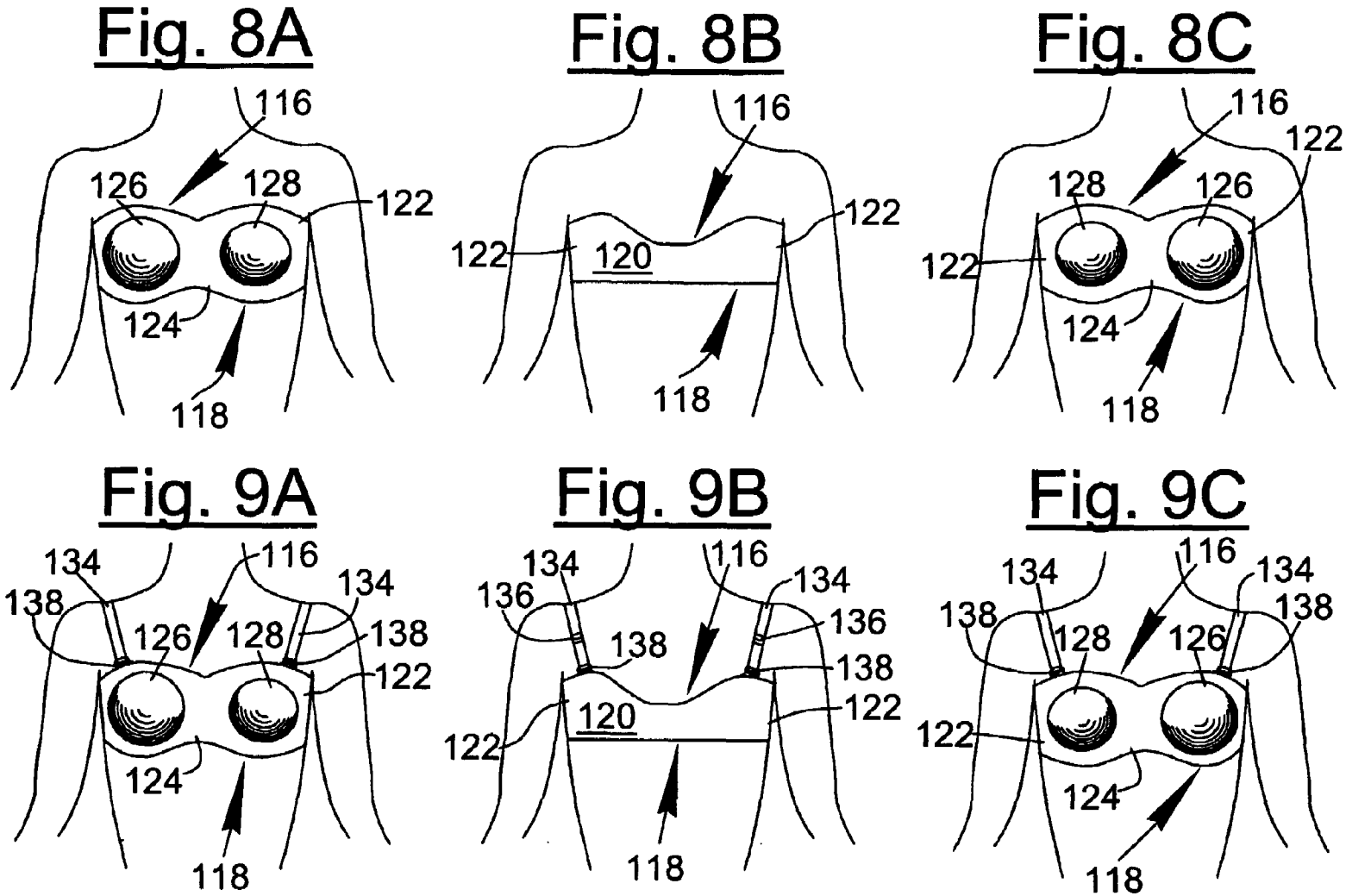
FIGS. 8A and 8B are front and back views of another embodiment of this invention, comprising a brassiere formed of stretchable material without closure means and shoulder straps.
FIG. 8C shows a brassiere according to the embodiment of FIG. 8A, the brassiere is turned inside-out to reverse the position of the breast cups.
FIGS. 9A, 9B, and 9C, are front and back views of the embodiment of FIGS. 8A, 8B and 8C but with removable shoulder straps attached.

These two embodiments are quite similar, except that the embodiment of FIGS. 8A–8C does not include the use of shoulder straps whereas the embodiment of FIGS. 9A–9C does provide for use of shoulder straps which are selectively removable from the brassiere.

More particularly, the embodiment of FIGS. 8A–8C shows a strapless brassiere 116 including a unitary body portion 118 comprising a back section 120, side sections 122, and front section 124, and asymmetrical breast cups 126 and 128.

The right breast cup 128 is shown in FIG. 8A as being smaller than the left cup 126, thus providing a brassiere adapted for reception and support of asymmetrical breasts, of which the left breast is the smaller. As in earlier embodiments, depending upon the extent of the size difference, a brassiere 116 providing a cup difference anywhere between one half and one and one half sizes may be appropriate.

This embodiment does not require any type of closure as the unitary body portion 118 is made as a continuous band of an elastic material with expandable stitching which will stretch enough to permit its being pulled into place over the head and shoulders of the wearer while still providing a comfortable fit around her chest and adequate support for her breasts. Because of its flexible nature, this embodiment is readily reversible to position the breast cups 126 and 128 as illustrated in FIG. 8C.

The FIGS. 9A–9C embodiment is the same as the FIGS. 8A–8C embodiment 132 except for the addition of removable and adjustable shoulder straps 134. Each strap 108 preferably includes length adjusting means 136, which may be any one of several devices now known and used for adjusting the length of such straps. Each end of each strap is provided with a hook member 138 which is removably positioned in a short open ended channel (not shown) formed in the body portion of the brassiere at the positions shown in the drawings.

Excluding the matter of the shoulder straps 134 all descriptions and comments concerning the embodiment of FIGS. 8A–8C apply to the embodiment of FIGS. 9A–9C.

SUMMARY

While it will be clear from the preceding descriptions that the present invention is susceptible of various modifications and alternative structures, it should be understood that applicant has no intention of limiting this invention to the specific forms disclosed, but on the contrary, the invention is to cover all modifications, alternative structures and equivalents falling within the spirit and scope of the invention.

From the foregoing, it will be apparent that the present invention brings to the art new, improved and long needed innovations which will be welcomed be those women who, for many years, have been troubled, inconvenienced and in many instances subjected to pain and discomfort because of the inability of the garment industry to provide unitary brassieres capable of properly and comfortably receiving and supporting asymmetrical breasts.

I claim:

1. A brassiere for use by a woman having asymmetrical breasts, such brassiere comprising a unitary body portion for encircling the chest of the woman, a first cup positioned on said body portion for disposition over one breast of the woman, a second cup differing in size from said first cup and positioned on said body portion for disposition over the other breast of the woman, each said cup being sized to comfortably receive and support the breast positioned therein, said unitary body portion defining first and second ends, means for releasably connecting said first and second ends to secure said body portion around the woman's chest with the breasts enclosed within and supported by said cups, said connecting means comprising a relatively flat center panel extending from said first end toward said second end, fastener material disposed on and carried by said center panel, a receptor unit comprising a pair of coextensive receptor panels extending from said second end toward said first end, the outer end of said receptor panels being flexible and manually separable to define an opening therebetween for the reception of the outer end of said center panel, the interior surfaces of said receptor panels having fastener material positioned thereon for releasable engagement with said fastener material carried by said center panel upon movement of the outer end of said center panel into the space between said receptor panels, said fastener materials releasably connecting said center panel and said receptor panels to maintain said ends against inadvertent relative movement, during wearing of the brassiere.

2. A brassiere according to claim 1, characterized by said unitary body portion comprising a back section adapted to extend across the back of the woman, side sections adapted to extend from said back section around the sides of the woman, and front sections adapted to extend from said side sections across the front of the woman, said first cup being positioned on one of said front sections for disposition over one breast of the woman, said second cup being positioned on the other of said front sections for disposition over the other breast of the woman, and said first and second ends of said body portion defining an opening located in the front of the body portion between said front sections, such opening being selectively closed by said connecting means upon placement of said unitary body portion around the chest of the woman.

3. A brassiere according to claim 1, characterized by said unitary body portion comprising a back section adapted to extend across the back of the woman, side sections adapted to extend from said back section around the sides of the woman, and front sections adapted to extend from said side sections across the front of the woman, said first cup being positioned on one of said front sections for disposition over one breast of the woman, said second cup being positioned on the other of said front sections for disposition over the other breast of the woman, and said first and second ends of said unitary body portion defining an opening located in the back section substantially at the mid point thereof, such opening being selectively closed by said connecting means upon placement of said unitary body portion around the chest of the woman.

4. A brassiere according to claim 1, characterized by a said center panel extending from one of said front section ends and being provided with loop material on opposite outwardly facing surfaces thereof, a said pair of second receptor panels extending from the other of said front section ends, said second panels being coextensive and provided on their inner facing surfaces with hook material, said loop material on said center panel releasably engaging said hook material on said second receptor panels upon positioning said center panel between said receptor panels and pressing said receptor panels together.

5. A brassiere according to claim 1, characterized by the material, seaming and structure of said breast cups and said unitary body portion being sufficiently elastic to permit turning of the brassiere and said cups inside out to reverse the orientation of said cups, the surfaces of said breast cups and said unitary body portion being sufficiently smooth tactilely to provide a comfortable fit and feel for the user of the brassiere in both orientations.

6. A brassiere according to claim 4, characterized by shoulder straps extending between each of said front sections and said back section, means for selectively adjusting the length of said shoulder straps to adjust the fit of the brassiere on the woman, said shoulder straps being selectively detachable from said front sections and said back section to provide a strapless brassiere.

7. A brassiere for use by a woman having asymmetrical breasts, such brassiere comprising a back section adapted to extend across the back of the woman, side sections adapted to extend from said back section around the sides of the woman, and front sections adapted to extend from said side sections across the front of the woman, said back section, side sections and front sections comprising a continuous unitary body portion for encircling the chest of the woman, a first cup positioned on said body portion for disposition over one breast of the woman, a second cup differing in size from said first cup and positioned on said body portion for disposition over the other breast of the woman, each said cup being sized to comfortably receive and support the breast positioned therein, the material of said unitary body portion and said cups being elastic and adapted to stretch sufficiently to permit turning of the unitary body portion and said cups inside out to reverse orientation of said cups, and donning of the brassiere over the head and shoulders of the woman.

* * * * *